US011259589B2

(12) United States Patent
Thorn

(10) Patent No.: US 11,259,589 B2
(45) Date of Patent: Mar. 1, 2022

(54) FLEX CROWN

(71) Applicant: Shawanda M. Thorn, Prosper, TX (US)

(72) Inventor: Shawanda M. Thorn, Prosper, TX (US)

( * ) Notice: Subject to any disclaimer, the term of this patent is extended or adjusted under 35 U.S.C. 154(b) by 233 days.

(21) Appl. No.: 16/732,138

(22) Filed: Dec. 31, 2019

(65) Prior Publication Data

US 2021/0195983 A1 Jul. 1, 2021

(51) Int. Cl.

| | |
|---|---|
| ***A42C 3/02*** | (2006.01) |
| ***A47F 5/10*** | (2006.01) |
| ***A47F 7/06*** | (2006.01) |
| ***A45D 44/14*** | (2006.01) |
| ***A47G 25/10*** | (2006.01) |
| ***A47F 8/00*** | (2006.01) |

(52) U.S. Cl.

CPC ..... *A42C 3/02* (2013.01); *A45D 44/14* (2013.01); *A47F 5/10* (2013.01); *A47F 7/06* (2013.01); *A47F 8/00* (2013.01); *A47G 25/10* (2013.01)

(58) Field of Classification Search

CPC ..... G09B 23/30; G09B 23/32; A47G 25/10; A42C 3/00; A42C 3/02; A45D 44/14; A47F 5/10; A47F 7/06; A47F 7/065; A47F 8/00

See application file for complete search history.

(56) References Cited

U.S. PATENT DOCUMENTS

| | | | | | |
|---|---|---|---|---|---|
| 11,302 | A * | 7/1854 | Brown | A42C 3/00 | 223/25 |
| 37,993 | A * | 3/1863 | Lyon | A42C 3/00 | 223/25 |
| 157,845 | A * | 12/1874 | Levering | A42C 3/00 | 223/25 |
| 334,236 | A * | 1/1886 | Keator | A42C 3/00 | 223/25 |
| 365,575 | A * | 6/1887 | Campbell | A42C 3/00 | 223/25 |
| 1,578,186 | A * | 3/1926 | Brodin | A42C 3/00 | 223/25 |
| 1,581,940 | A * | 4/1926 | Margolin | A42C 3/00 | 223/25 |
| 2,831,286 | A * | 4/1958 | Eisner | B44C 3/04 | 249/112 |
| 3,009,265 | A * | 11/1961 | Bezark | G09B 23/34 | 434/270 |
| 3,038,260 | A * | 6/1962 | Massad | A42C 3/00 | 33/512 |

(Continued)

*Primary Examiner* — Patrick D Hawn
(74) *Attorney, Agent, or Firm* — Gibraltar Consulting LLC; Tariq S. Najee-Ullah

(57) ABSTRACT

An adjustable three dimensional mannequin head is provided for fitting a variety of head gear including but not limited to wigs, hats, caps, helmets and similar items. The adjustable mannequin head consist of a plurality of parts that move in a synchronized manner to expand and contract the size of the adjustable mannequin head to allow fitting to size; wigs, hats, and similar items. The mannequin head consist of four quadrants that make up the crown of the head. These four quadrants are mechanically adjusted by a single screw, which when turned will either expand or contract the adjustable mannequin head based on the direction the screw is turned. The adjustable mannequin head provides matching and fitting head gear to individual heads.

20 Claims, 15 Drawing Sheets

(56) References Cited

U.S. PATENT DOCUMENTS

| | | | | | |
|---|---|---|---|---|---|
| 3,197,093 | A * | 7/1965 | Doran | A47F 7/06 | 223/66 |
| 3,462,050 | A * | 8/1969 | Hensley | A45D 44/14 | 223/66 |
| 3,709,407 | A * | 1/1973 | Sanford | A45D 44/14 | 223/66 |
| 4,263,743 | A * | 4/1981 | Hanson | A63H 3/14 | 446/329 |
| 4,708,836 | A * | 11/1987 | Gain | G09B 23/30 | 264/222 |
| 5,090,910 | A * | 2/1992 | Narlo | G09B 23/34 | 434/100 |
| 8,056,427 | B2 * | 11/2011 | Wang | G09B 23/30 | 73/866.4 |
| 9,826,954 | B2 * | 11/2017 | Petel | A61B 6/50 | |
| 11,151,901 | B2 * | 10/2021 | Zhao | G09B 23/288 | |
| 2010/0163066 | A1 * | 7/2010 | Robinshtain | A47F 8/00 | 132/53 |
| 2018/0247567 | A1 * | 8/2018 | Wang | G09B 23/34 | |
| 2019/0082811 | A1 * | 3/2019 | Gray | G09B 25/00 | |

* cited by examiner

TOP VIEW

ISO VIEW

FRONT VIEW

SIDE VIEW

REAR VIEW

Assembled

Disassembled

Assembled

Disassembled

Assembled

Disassembled

Assembled

Disassembled

Assembled

Disassembled

FLEXCROWN

FLEXCROWN

CLOSED POSITION

FLEXCROWN

OPEN POSITION

Views showing the open and closed positions of the main bracket system

FLEX CROWN

TECHNICAL FIELD

This disclosure generally relates to a three-dimensional object configured by a plurality of synchronized adjustable parts and more particularly relates to an adjustable mannequin head configured to adapt to multiple sizes for the designing and creation of wigs. The mannequin head can also be used to fit a variety of head wear including but not limited to hats, caps, and helmets etc.

BACKGROUND FIELD OF THE INVENTION

The present invention is in the field of mannequin heads.

DESCRIPTION OF THE BACKGROUND ART

In the wig industry, there are mannequin heads of different sizes, shapes, materials, and colors, all for the purpose of making the perfect wig for the end client. The major issue with the traditional mannequin head is that it's difficult to make a wig for more than one client using the same mannequin head. If the clients' head is a larger or smaller circumference, the wig maker would have to buy several mannequin heads to accommodate for the different size heads of their clients. Currently, wig makers are forced to buy upwards of six mannequin heads to accommodate their clientele. This leads to clutter; storage issues and makes traveling to meet clients inconvenient, for the wig maker. Therefore, what's clearly needed is an expandable mannequin head that accommodates every potential head size of the client, solving the problems mentioned above.

SUMMARY

The adjustable mannequin head that is configured by a plurality of parts that moves in a synchronized manner when expanding and contracting is a needed solution for the wig making industry. In one embodiment of the invention, an adjustable five-way mannequin head assembly is provided; comprised of five adjustable synchronized assemblies mounted on a mannequin head base. Each section of the assembly consists of a structural frame that is covered with a flexible material that attaches to moving sections. Four brackets glide on their independent set of liner rods which functions as a guide rail system. The fifth section moves on a machined screw. This system is designed to adjust each section in a synchronized motion. Four sections move inward and outward and the fifth section that moves up and down. This synchronized motion is controlled with a single screw that is connected to a plurality of gears. Four of the sections have a mechanical bracket assembly with a miter gear that connects to a spinal gear assembly. The spinal gear assembly has its' own set of miter gears. Therefore, when the motion is initiated, all five adjustable sections will move in a synchronized manner which provides a mannequin head that is adjustable.

DETAILED DESCRIPTION OF EMBODIMENT

Hereinafter, an embodiment of the present disclosure will be described with reference to the drawings.

(Configuration of the Expandable Mannequin Head)

Figure 1:
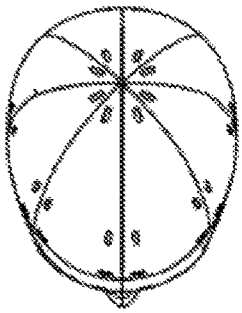
FIG. 1 is the top view, iso view, front view, side view and rear view of the adjustable mannequin head fully closed.
Figure 1:
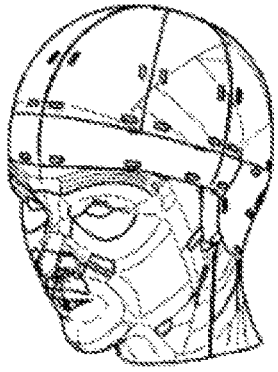
Figure 1:
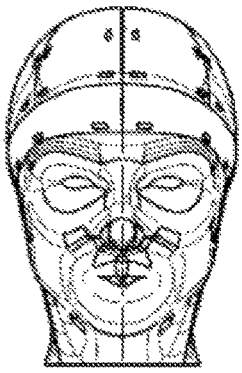
Figure 1:
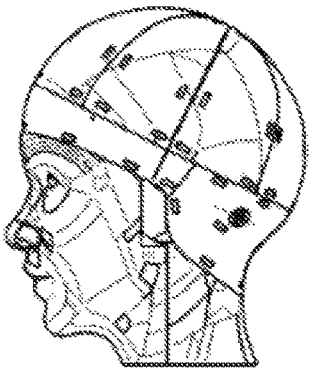
Figure 1:
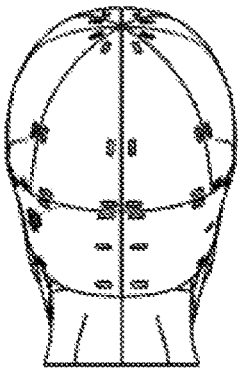

FIG. 1 is a top view, ISO view, front view, side view and rear view of the expandable mannequin head fully assembled.

The top view illustrates a perspective in which the top portion of the 4 quadrants of the mannequin can be viewed. The front view illustrates the front portion of the mannequin head and how the adjustable quadrants flows with the facial features of the mannequin head. The side view illustrates a profile of the mannequin head and how the side of the adjustable portion create a smooth transition from the front to the back of the mannequin head. The rear view illustrates how the adjustable portion of the mannequin head flows with the rear neck contour of the mannequin head. The ISO view illustrates a compound perspective of how the entire mannequin will appear in the closed position.

The present embodiment is the object of a head region of a human. It illustrates a non-limiting example of an expandable mannequin head that is suitable for use of creating wigs of various sizes but not limited to only the construction of wigs but any kind of product of various kinds that is used for the human head that requires a range of sizes. Apart from the use of designing and construction wigs, this expandable mannequin head can be used to display a variety of headgear or products for both males and females.

Figure 2A:
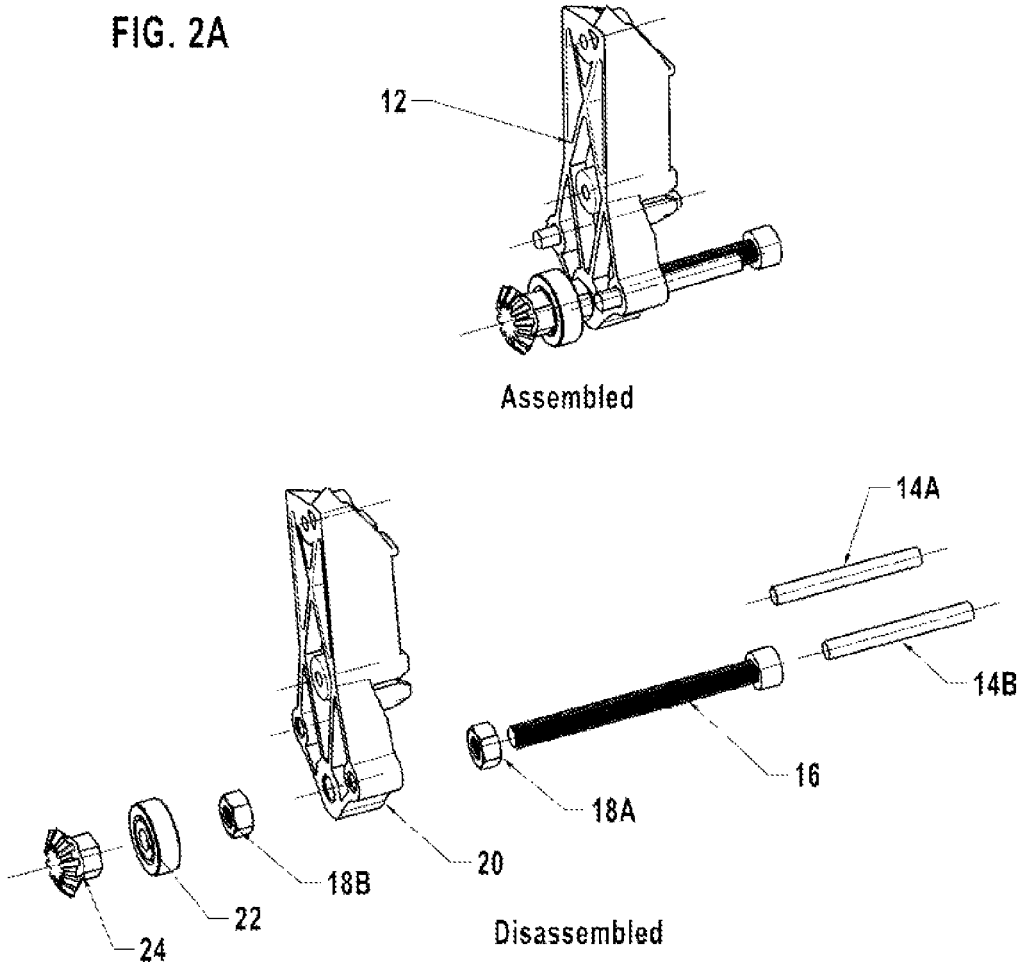
FIG. 2A is the driver lower adjustable gear assembly (assembled and disassembled).

FIG. 2A, illustrates a non-limiting example of the driver lower gear assembly 12 (assembled and disassembled) which consist of the following components: guide rods 14A and 14B, right-hand M6 socket head screw 16, right-hand M6 machined nut 18A, bracket long 20, right-hand M6 machined nut 18B, M6 Bearing 22, and M6 11 teeth miter gear 24.

Guide rods 14A and 14B allows bracket long 20 to glide back and forth along the length of the rods as well a means to prevent bracket long 20 from rotating during this linear movement. Right-hand M6 socket head screw 16, is the driver that moves the right-hand M6 machined nut 18A along the screw threads. Right-hand M6 machined nut 18A is pressed fitted into bracket long 20 that moves with right-hand M6 machined nut 18A. Right-hand M6 machined nut 18B is threaded onto the right-hand M6 socket head screw 16, and then M6 Bearing 22 is placed on the right-hand M6 socket head screw 16. M6 11 teeth miter gear 24 is then threaded onto the end of the right-hand M6 socket head screw 16. M6 machined nut 18B is threaded to clamp M6 Bearing 22 against M6 11 teeth miter gear 24. Clamping components right-hand M6 machined nut 18B, M6 Bearing 22, and M6 11 teeth miter gear 24 together and held in a fix location will prevent the right-hand M6 socket head screw 16 from moving and only allows the bracket long 20 which is attached to M6 machined nut 18A to move linearly back and forth when the right-hand M6 socket head screw 16 turned counter clockwise and clockwise. Lastly, M6 11 teeth miter gear 24 will rotate with the right-hand M6 socket head screw 16 (when turned) which provides movement for other assemblies that interlocked with this assembly.

Figure 2B:
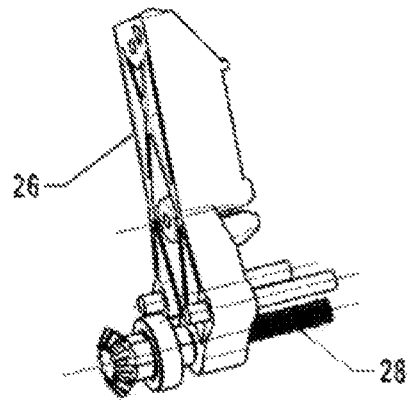
FIG. 2B is the lower adjustable gear assembly (assembled).

FIG. 2B illustrates a non-limiting example of the lower gear assembly 26 assembled which consists of the same components as the driver lower gear assembly 12 with the exception of M6 right-hand screw rod 28 (different from M6 socket head screw 16 from FIG. 2A).

This assembly shares the same functionalities and chain reaction of motion described for driver lower gear assembly 12.

Figure 2C:
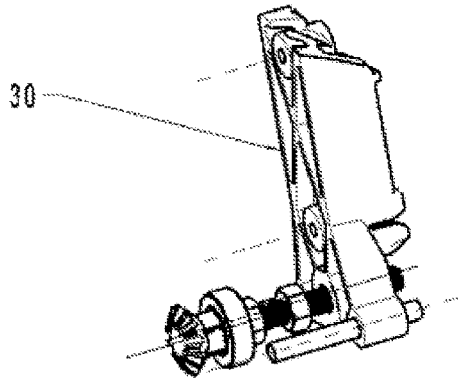
FIG. 2C is the upper adjustable gear assembly (assembled and disassembled).
Figure 2C:
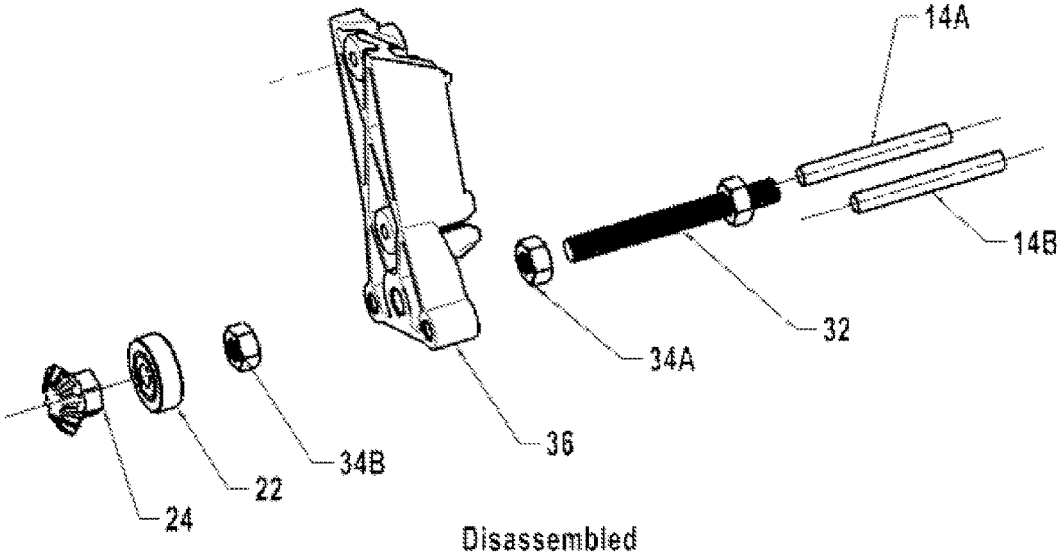

FIG. 2C illustrates a non-limiting example of the upper gear assembly 30 (assembled and disassembled) which consist of the following components; guide rods 14A and 14B, left-hand M6 screw rod 32, left-hand M6 machined nut 34A, bracket short 36, left-hand M6 machined nut 34B, M6 Bearing 22, and M6 11 teeth miter gear 24.

This assembly shares the same functionalities and chain reaction of motion described for driver lower gear assembly 12.

Figure 2D:
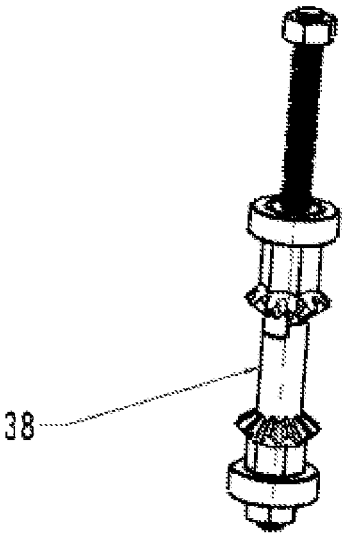
FIG. 2D is the vertical spinal gear assembly (assembled and disassembled).
Figure 2D:
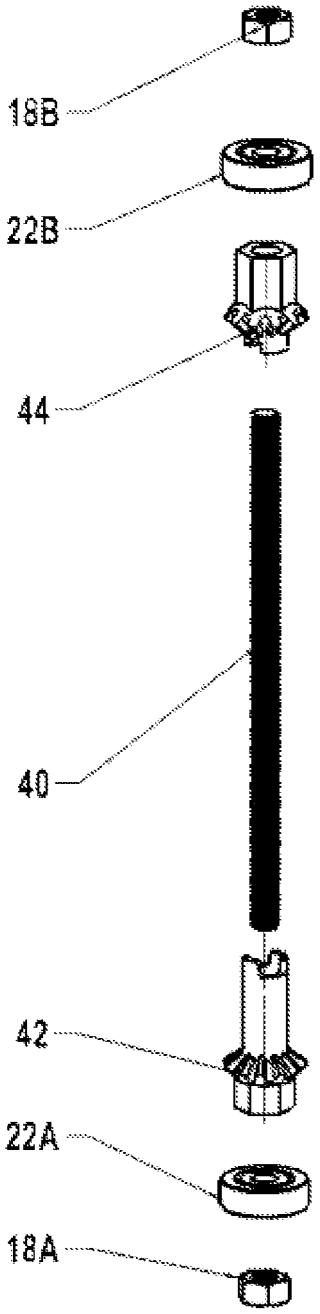

FIG. 2D illustrates a non-limiting example of the spinal gear assembly 38 (assembled and disassembled) which consist of the following components; right-hand M6 machined nut 18A, M6 Bearing 22A, lower spinal female miter gear 42, M6 right-hand screw rod 40, upper spinal male miter gear 44, M6 Bearing 22B, and right-hand M6 machined nut 18B.

The lower spinal female miter gear 42 is threaded onto the bottom of M6 right-hand screw rod 40 and then component M6 Bearing 22A is placed onto M6 right-hand screw rod 40 followed by threading M6 machined nut 18A which will lock and clamp M6 Bearing 22A between M6 machined nut 18A and lower spinal female miter gear 42. Component upper spinal male miter gear 44 is placed onto the top side of M6 right-hand screw rod 40 along with M6 Bearing 22A. M6 machined nut 18B is threaded on the top side of M6 right-hand screw rod 40. This nut will later function as a mechanical component to move the upper cap assembly 46 in FIG. 3.

Figure 3:
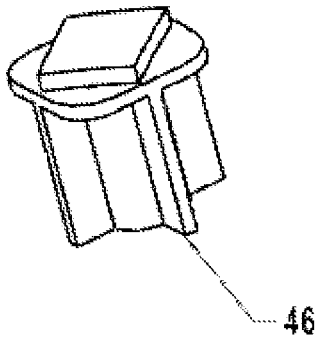
FIG. 3 is the guide upper cap assembly (assembled and disassembled).
Figure 3:
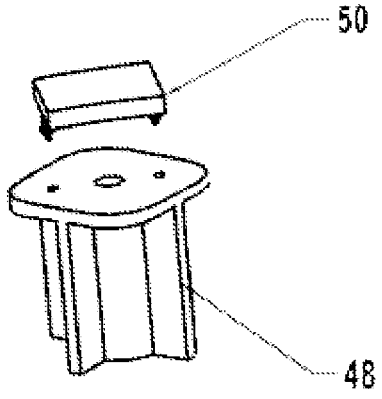

FIG. 3 illustrates a non-limiting example of the upper cap assembly 46 (assembled and disassembled) which consists of the following components; Glide Upper Cap 48, and Soft Upper Cap 50.

Glide Upper Cap 48 functions as a mechanical structure that aligns and interfaces with guide upper cap assembly 56 of FIG. 4B (shown later). Soft Upper Cap 50 functions as an aesthetic component to provide a consistent appears for the entire assembly in the expanded position. The upper cap assembly 46 functions as a center closeout component when the mannequin head is fully expanded. The upper cap assembly 46 moves up and down when motion is driven by the M6 machined nut 18B from FIG. 2D.

Figure 4A:
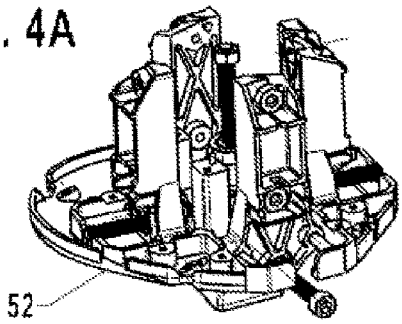
FIG. 4A is the adjustable plate assembly (assembled and disassembled).
Figure 4A:
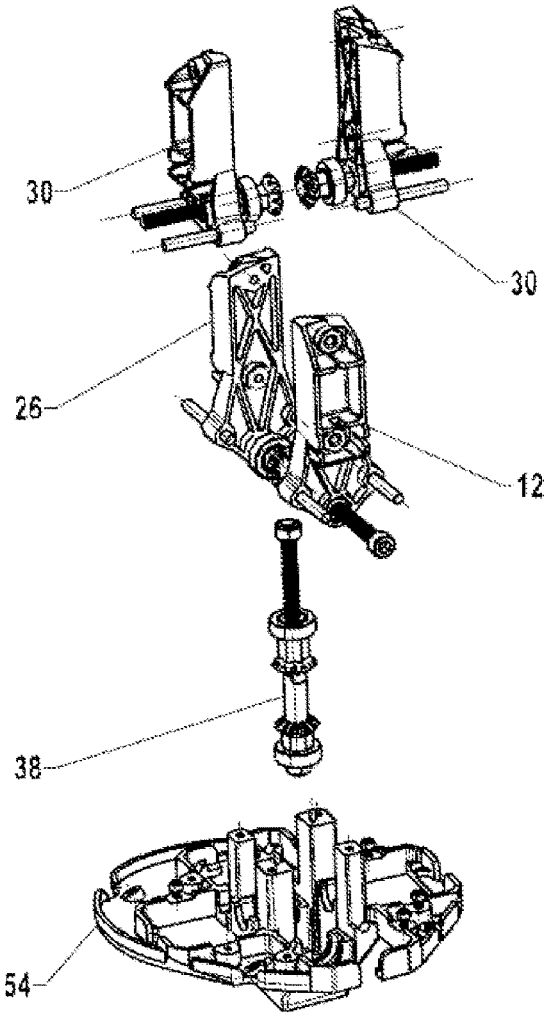

FIG. 4A illustrates a non-limiting example of the adjustable plate assembly 52 (assembled and disassembled) which consists of the following components; adjustable plate 54, spinal gear assembly 38, driver lower gear assembly 12, lower gear assembly 26, and (2) upper gear assembly 30.

The adjustable plate 54 functions as the main base that holds, aligns, and mounts several assemblies. Spinal gear assembly 38 is aligned and seated in the center of the adjustable plate 54. Spinal gear assembly 38 function as the secondary feeder which drives the movement of the multiple assemblies. Driver lower gear assembly 12 and lower gear assembly 26 are aligned within mechanical features on the adjustable plate 54. Guide rods 14A and 14B functions as up-down and side to side alignments. M6 Bearing 22 functions as an in and out alignment for both driver lower gear assembly 12 and lower gear assembly 26. The (2) upper gear assembly 30 are aligned within mechanical features on the adjustable plate 54. Guide rods 14A and 14B functions as up-down and side to side alignment. M6 Bearing 22 functions as an in-out alignment for the (2) upper gear assembly 30. The (2) upper gear assembly 30 are position higher within adjustable plate 54 to provide clearance from driver lower gear assembly 12 and lower gear assembly 26. The M6 11 teeth miter gear 24 from driver lower gear assembly 12 and lower gear assembly 26 are seated and aligns on the top side of lower spinal female miter gear 42 from FIG. 2D. The upper spinal male miter gear 44 from FIG. 2D is seated and aligned to M6 11 teeth miter gear 24 from the (2) upper gear assembly 30.

Figure 4B:
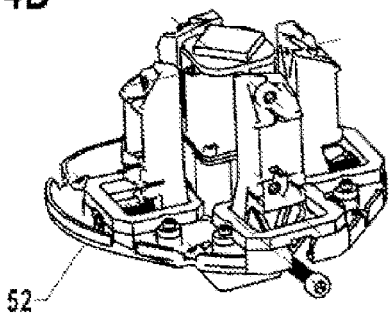
FIG. 4B is the continuation of the adjustable plate assembly (assembled and disassembled).
Figure 4B:
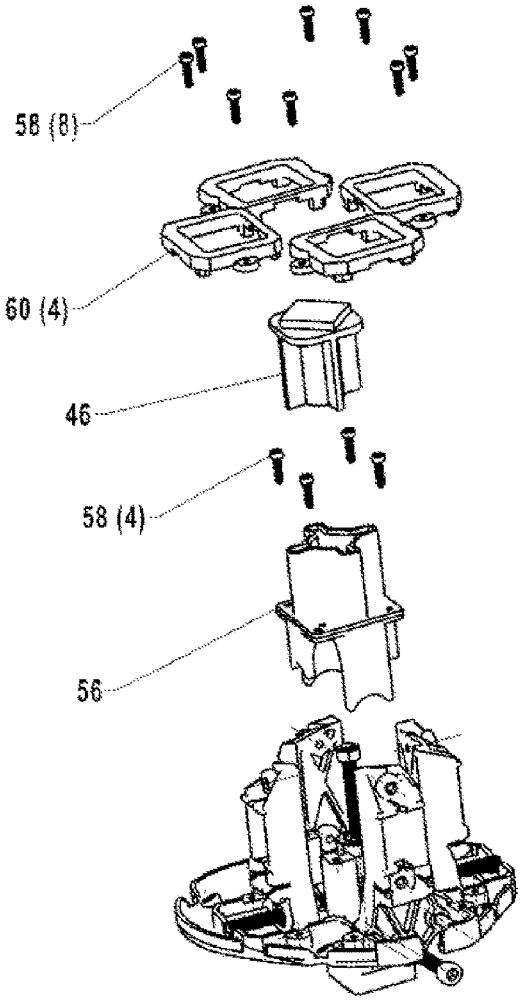

FIG. 4B (continuation from FIG. 4A) illustrates a non-limiting example of the adjustable plate assembly 52 (assembled and disassembled) which consist of the following components; guide upper cap assembly 56, (4) M3 socket head screws 58, upper cap assembly 46, (4) cover plate 60, and (8) M3 socket head screws 58.

Guide upper cap assembly 56 functions as an up-down support for M6 Bearing 22 from driver lower gear assembly 12, lower gear assembly 26, the (2) upper gear assembly 30. This support ensures that all gears will maintain engagement. Guide upper cap assembly 56 functions as a mechanical clamp for spinal gear assembly 38, M6 Bearing 22B from FIG. 2D is aligned within a mechanical feature on guide upper cap assembly 56. The top half of the guide upper cap assembly 56 functions as a guide rail system for upper cap assembly 46. The vertical ribs on upper cap assembly 46 glides within the vertical slots on guide upper cap assembly 56 in an up-down motion. The (4) cover plate 60 functions as a clamping component for the guide rods 14A and 14B from FIG. 2A, FIG. 2B, and FIG. 2C to the adjustable plate 54. These covers a secured the adjustable plate 54 with (4) M3 socket head screws 58. Finally, M6 machined nut 18B from FIG. 2D is adjusted vertically to receive upper cap assembly 46 which is press fitted onto M6 machined nut 18B from FIG. 2D. Now upper cap assembly 46 can move up and down in sequence with the entire assembly.

Figure 5:
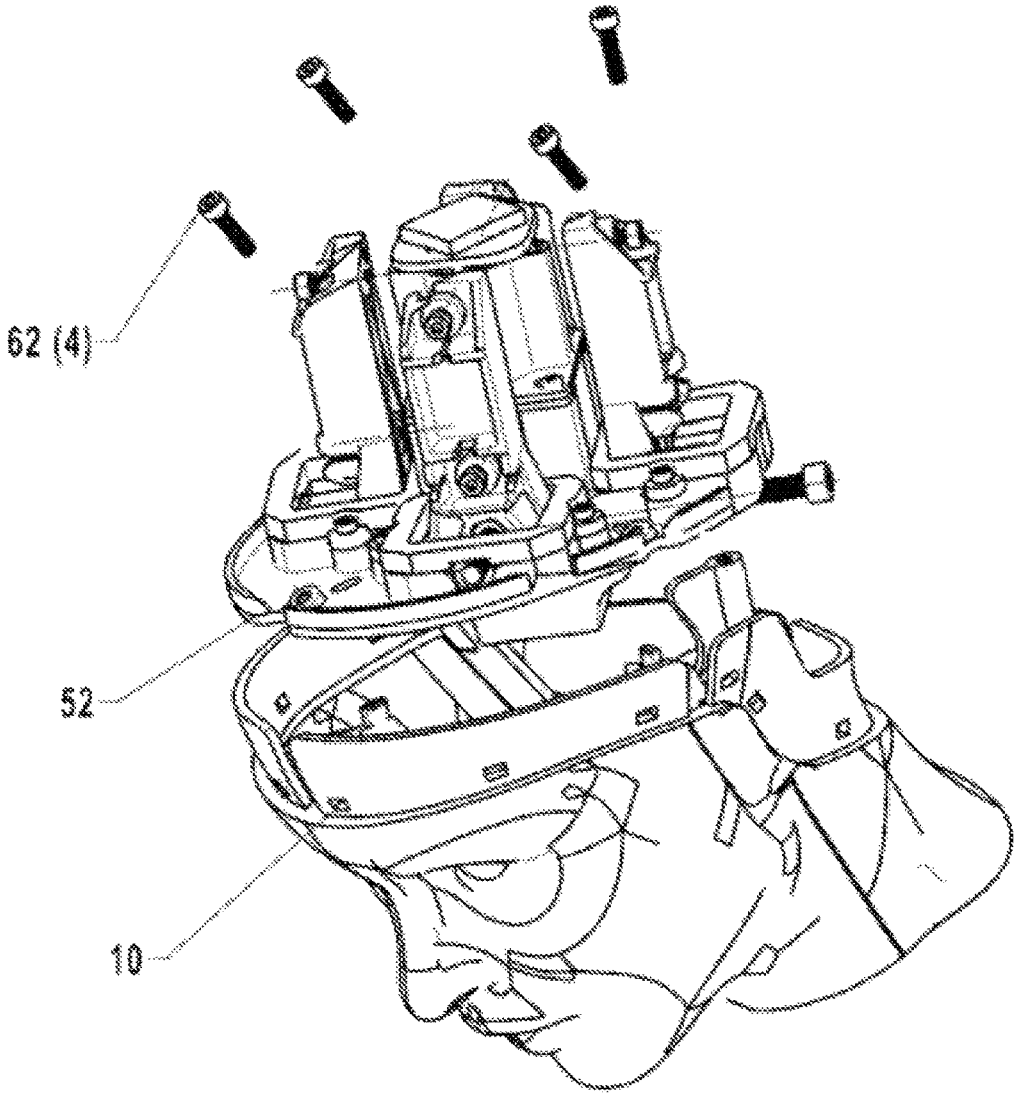
FIG. 5 is the adjustable plate assembly, mannequin head base, and screws disassembled.

FIG. 5 illustrates a non-limiting example of the mannequin head base 10, adjustable plate assembly 52 disassemble with (4) M4 socket head screws 62.

The mannequin head base 10 has human facial features with (4) mounting bosses and (3) location tabs to position and mount the adjustable plate assembly 52.

Figure 6:
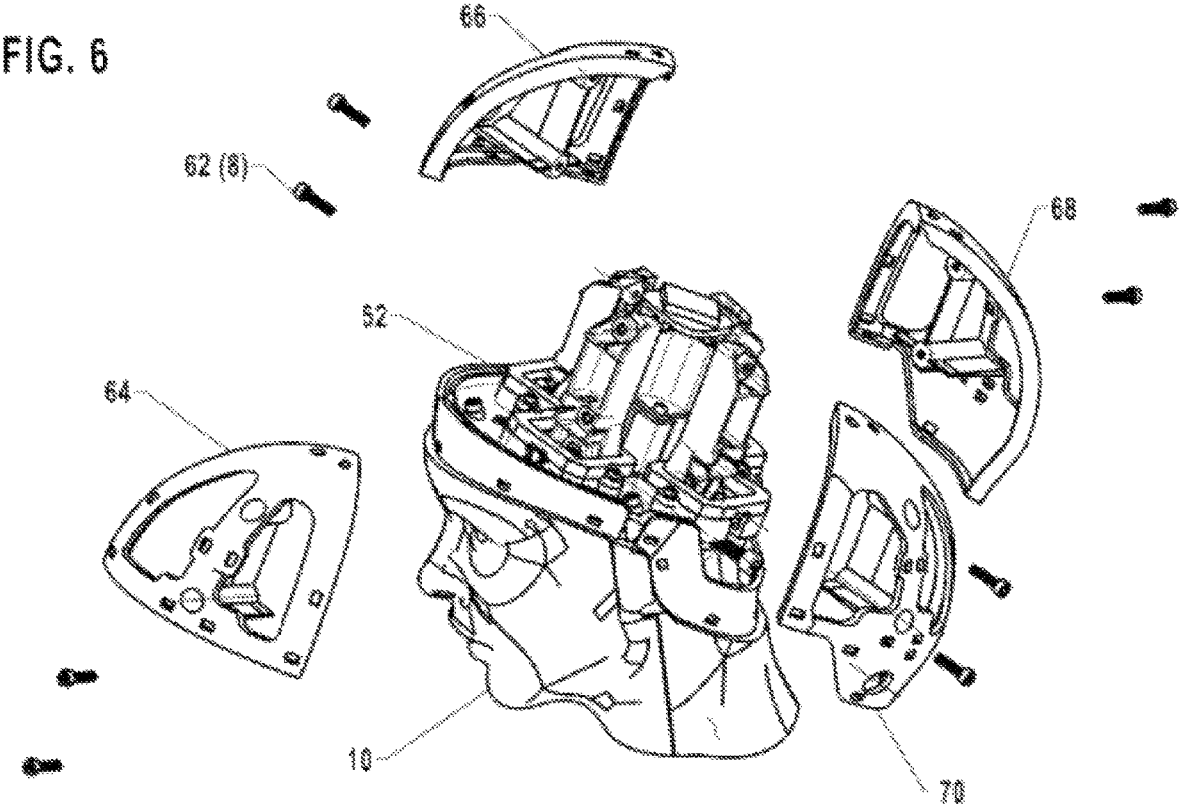
FIG. 6 is the adjustable plate assembly and mannequin head base (assembled) with the hardcover front right, hardcover front left, hardcover rear right, hardcover rear left, and screws disassembled.

FIG. 6 illustrates a non-limiting example of the adjustable plate assembly 52 and mannequin head base 10 (assembled) with the hardcover front left 64, hardcover front right 66, hardcover rear right 68, hardcover rear left 70, and (8) M4 socket head screws 62 disassembled.

The hardcovers services as the structural support for the top portion of the adjustable mannequin head. Each hard cover is attached to one of the brackets from plate assembly 52 and secured with (2) M4 socket head screws per hard cover. Each hardcover has 2 open areas designed to provide large clearances for needles to pass through each of the (4) soft covers (from FIG. 7) for securing a wig the mannequin head. There are several small rectangular openings designed on each hardcover to mechanically interlock with mechanical clamps (shown is FIG. 11B section A-A).

Figure 7:
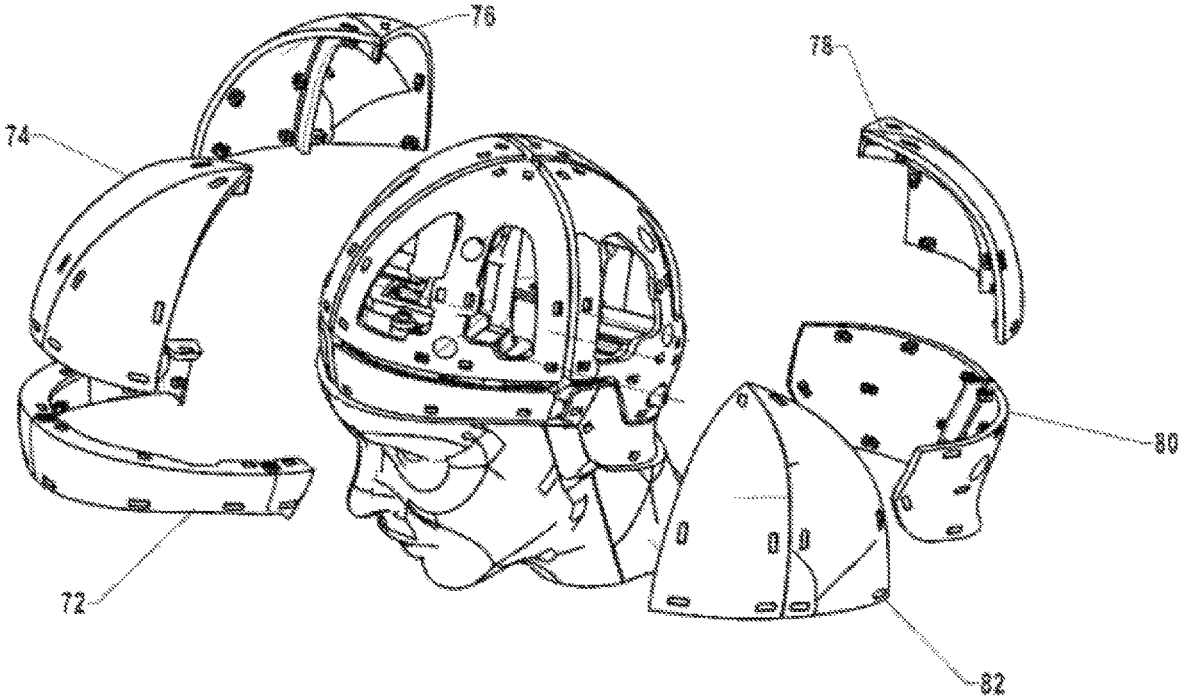
FIG. 7 is the mannequin head base, adjustable plate assembly, hardcover front right, hardcover front left, hardcover rear right, hardcover rear left (assembled) with the softcover front lower, softcover front, softcover side right, softcover rear, softcover rear lower and softcover side left disassembled.

FIG. 7 illustrates a non-limiting example of the (6) different soft covers that attaches to the adjustable mannequin head. These soft covers consist of the following components; softcover front lower 72, softcover front 74, softcover side right 76, softcover rear right 78, softcover rear lower 80, and softcover side left 82.

The function of the soft covers provides a flexible surface that will allows needles to pierce the soft material to hold the wig in position on the mannequin head during the construction process. The flexible material provides a way for the adjustable mannequin head to expand and contract mechanically while maintaining a structural shape that emulates a human head of multiple sizes. There are several small rectangular openings on each soft cover designed to secure the soft covers to the each hardcover and mannequin head mechanically with mechanical clamps (shown is FIG. 11B section A-A).

Figure 8:
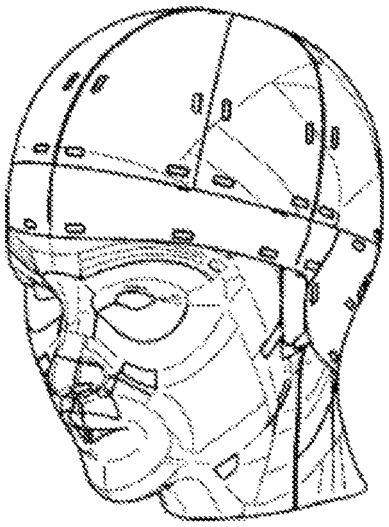
FIG. 8 is the fully assembled mannequin head.

FIG. 8 illustrates a non-limiting example of the fully assembled adjustable mannequin head. (FlexCrown)

Figure 9:
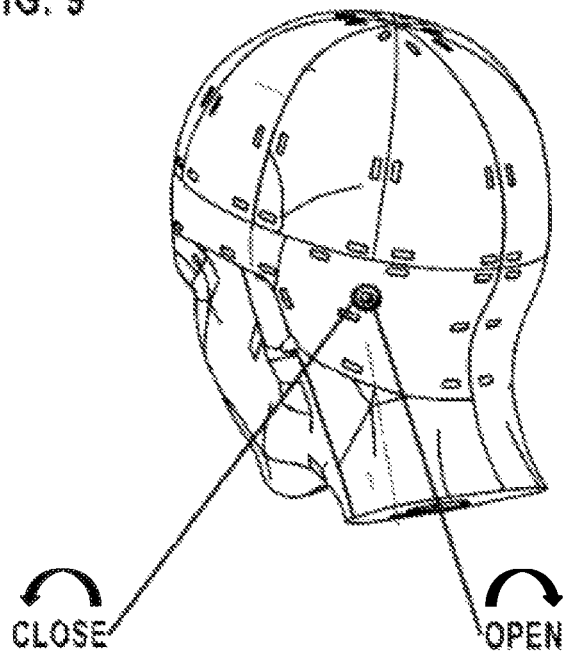
FIG. 9 is the rear view of the mannequin head identifying the main adjustment screw.

FIG. 9 illustrates a non-limiting example of a rear view of the adjustable mannequin head showing the single driving screw that expands and contracts the mannequin head. Turning the screw to the right will expand the head and turning the screw to the left will contract it.

Figure 10:
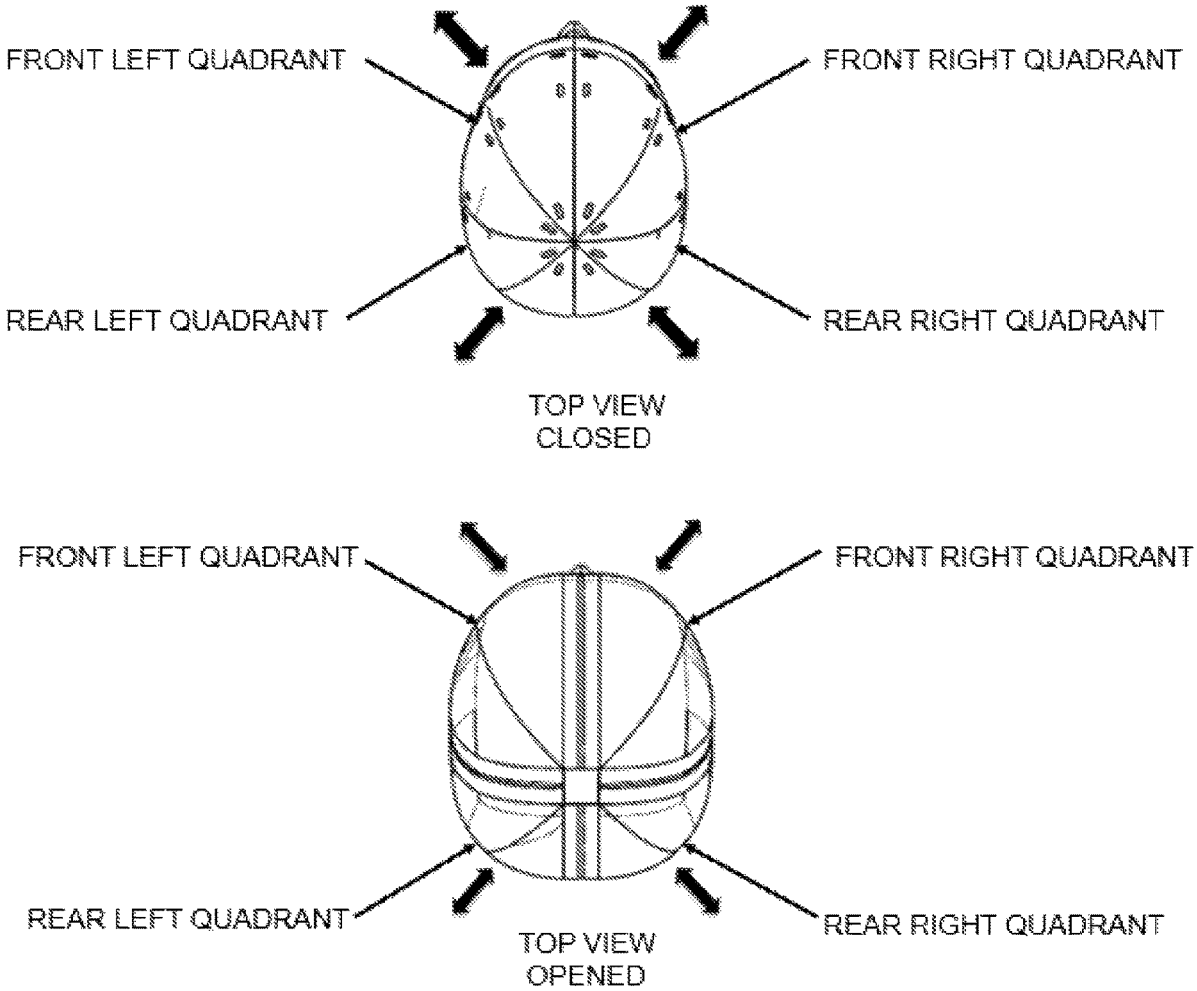
FIG. 10 is the top view closed showing the direction of movement for the four sections (later referred to as quadrants) in the closed position. Also, the top view open showing the direction of movement for the four sections (later referred to as quadrants) and the fifth section (later referred to as glide upper cap assembly) in the open position.

FIG. 10 illustrates a non-limiting example of the top view that demonstrates the direction in which the (4) quadrants will expand and contracts in both the closed and open positions.

Figure 11A:
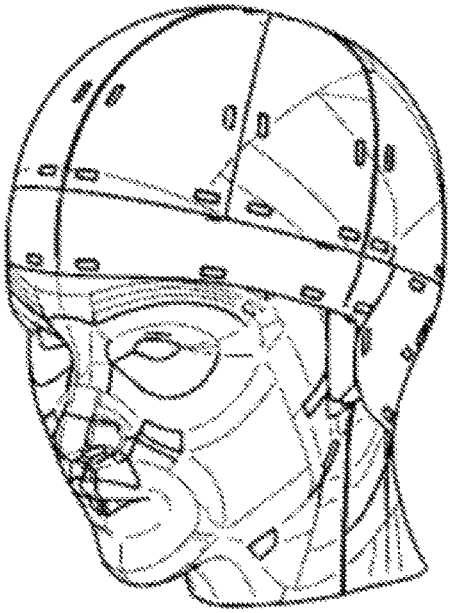
FIG. 11A is the closed and open positions of the complete adjustable mannequin head.
Figure 11A:
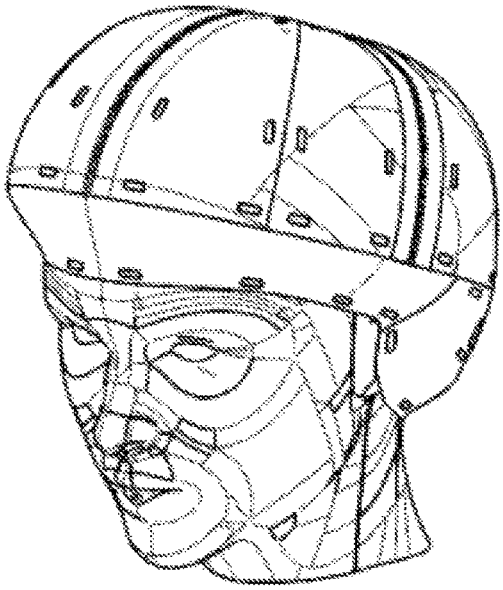

FIG. 11A illustrates a non-limiting example of the iso view of the adjustable mannequin head in both the closed position and the open position.

Figure 11B:
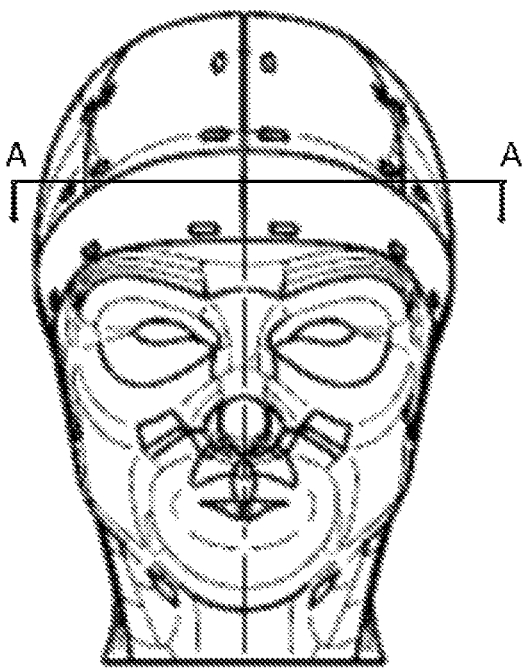
FIG. 11B illustrates a front view of the adjustable mannequin head with section A-A. The views under the front view are sections showing the closed and partially opened positions of the adjustable mannequin head.
Figure 11B:
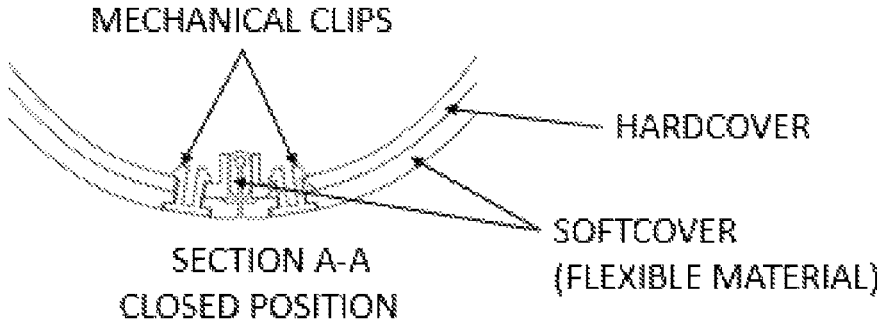
Figure 11B:
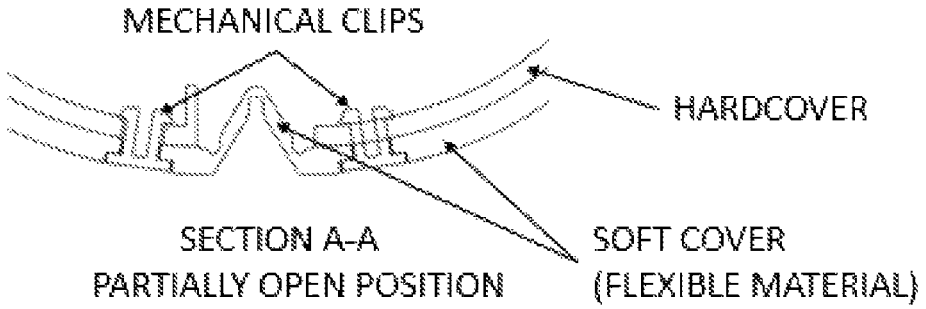

FIG. 11B illustrates a non-limiting example of a front view of the adjustable mannequin head with section A-A. The views below the front view are sections showing the closed and partially opened positions to illustrate how the soft covers are attached to the hardcovers mechanically. These views also illustrate how the flexible material of the soft covers will fold and unfold when adjusting the size of the adjustable mannequin head.

Figure 12:
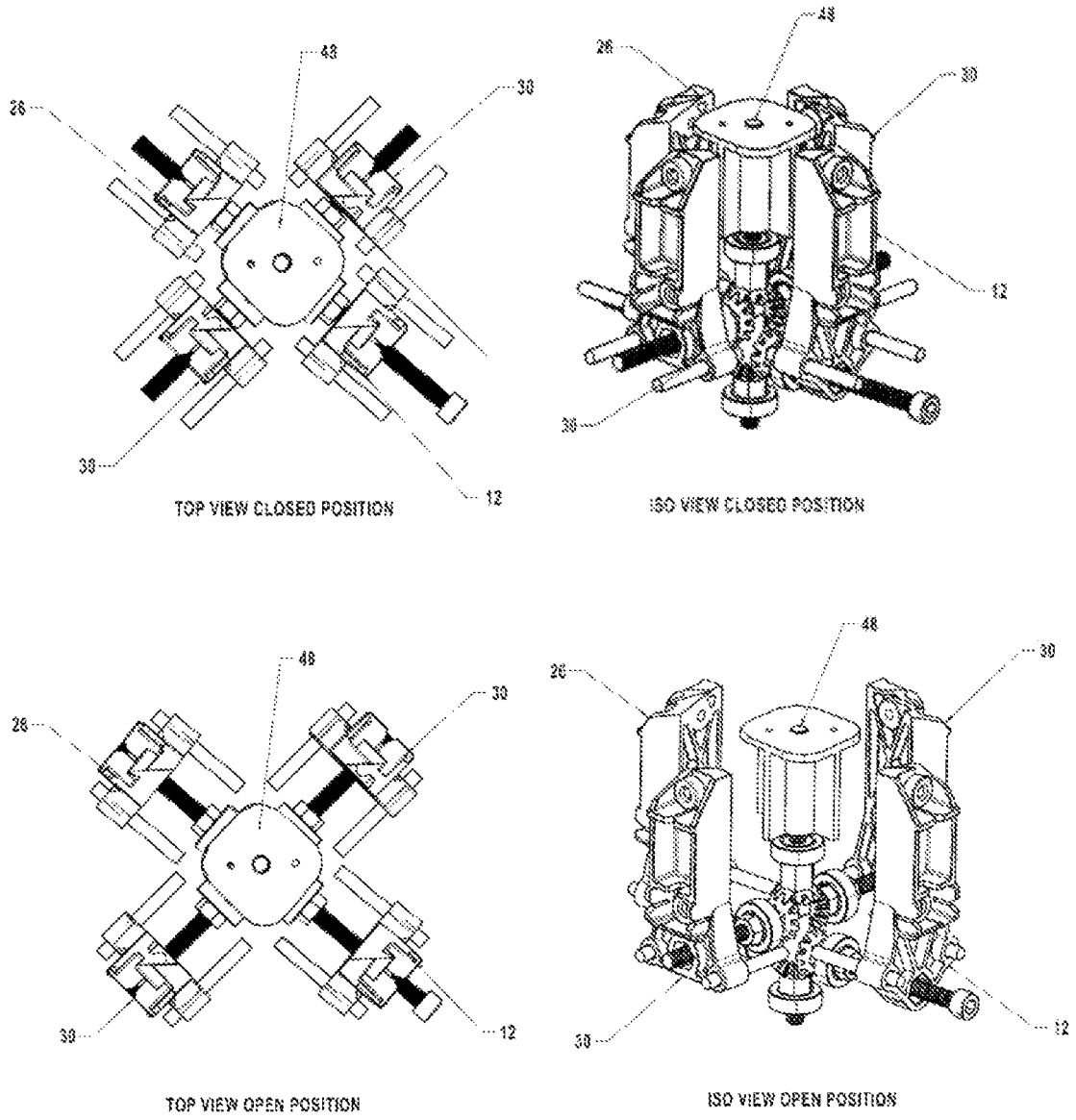
FIG. 12 is the internal moving components that drive the ability to open and close the adjustable mannequin head.

FIG. 12 illustrates a non-limiting example showing the open and closed positions of the adjustable bracket systems to clarify the mechanical movement of this invention that allows the adjustable mannequin head to adjust from the closed position to the open position.

Although not mentioned in the detailed description, the mannequin head may be adjusted or automated by incorporating or attaching a motorized mechanism as a means to adjusting the size of the adjustable mannequin head. One of ordinary skill in the art, would be able to automate the system of the adjustable mannequin head.

The invention claimed is:

1. An adjustable mannequin head comprising:

a crown forming a mechanical portion of said adjustable mannequin head, wherein said mechanical portion is movable;

adjustable quadrants providing a division of said crown;

a bracket system for attaching said adjustable quadrants;

a base for mounting said bracket system; and a single screw for adjusting a size of the adjustable mannequin head, wherein when turned, said single screw initiates the movement of the bracket system, which moves said adjustable quadrants of said crown.

2. The adjustable mannequin head of claim 1, wherein said single screw is turned clockwise to mechanically increase the size of the mannequin head.

3. The adjustable mannequin head of claim 1, wherein said single screw is turned counterclockwise to mechanically reduce the size of the mannequin head.

4. The adjustable mannequin head of claim 1, furthermore comprising a lower gear assembly consisting of at least one of each of the following: a nut, a bracket, a bearing, and a miter gear that drive the movement of multiple mechanical quadrants.

5. The adjustable mannequin head of claim 1, furthermore comprising a spinal gear assembly with a plurality of gears that control the movement of a driver lower gear assembly, a lower gear assembly, an upper gear assembly, and an upper cap assembly in harmonious synchronized motion.

6. The adjustable mannequin head of claim 1, further comprising a plurality of guide rods.

7. The adjustable mannequin head of claim 6, wherein said guide rods control the up/down, side to side, and rotation of a driver lower gear assembly, a lower gear assembly, and an upper gear assembly.

8. The adjustable mannequin head of claim 5, wherein said spinal gear assembly contains an M6 right-hand screw rod and an M6 nut that control the vertical up/down synchronized movement of a guide upper cap assembly.

9. The adjustable mannequin head of claim 5, wherein said spinal gear assembly causes the opposing driver lower gear assembly and lower gear assembly to contract and expand harmoniously.

10. The adjustable mannequin head of claim 5, wherein said spinal gear assembly causes two opposing upper gear assemblies to contract and expand harmoniously.

11. A method for adjusting the size of the mannequin head comprising:

providing a crown with a movable mechanical portion;

providing a division of said crown, by providing adjustable quadrants which makeup the crown;

providing a bracket system, wherein said adjustable quadrants are attached to said bracket system;

providing a base for mounting said bracket system; and adjusting the size of said mannequin head by turning a single screw, wherein said single screw initiates movement of the bracket system, which moves said adjustable quadrants of the crown.

12. The method for adjusting the size of the mannequin head of claim 11, further comprising: turning a right-hand M6 socket head screw; wherein the right-hand M6 socket head screw controls the movement of a driver lower gear assembly, spinal gear assembly, lower gear assembly, upper gear assembly and an upper cap assembly which controls the mechanical movement of the four quadrants.

13. The method for adjusting the size of the mannequin head of claim 12, further comprising: turning said driver lower gear assembly clockwise to move a hardcover rear left of the mannequin head outward.

14. The method for adjusting the size of the mannequin head of claim 13, wherein turning said driver lower gear assembly counterclockwise to hardcover rear left of the mannequin head to move inward.

15. The method for adjusting the size of the mannequin head of claim 12, further comprising: turning a driver lower gear assembly screw clockwise causing a connecting lower miter gear of the spinal gear assembly to turn clockwise which turns said lower gear assembly counterclockwise causing said hardcover front right to move outward.

16. The method for adjusting the size of the mannequin head of claim 15, wherein turning said driver lower gear assembly screw counterclockwise causing the connecting lower miter gear of the spinal gear assembly to turn counterclockwise which turns said lower gear assembly clockwise causing said hardcover front right to move inward.

17. The method for adjusting the size of the mannequin head of claim 12, further comprising: turning said driver lower gear assembly clockwise causing a connecting upper miter gear of the spinal gear assembly to turn clockwise which turns said upper gear assembly counter clockwise moving the two opposing upper gear assemblies and hardcover front left and hard cover rear right outward synchronously.

18. The method for adjusting the size of the mannequin head of claim 17, wherein turning said driver lower gear assembly counterclockwise causes the connecting upper miter gear of the spinal gear assembly to turn counterclockwise which turns said upper gear assembly clockwise moving the two opposing upper gear assemblies and hardcover front left and hardcover rear right inward synchronously.

19. The method for adjusting the size of the mannequin head of claim 12, further comprising: turning said driver lower gear assembly clockwise causing the connecting spinal gear assembly to turn clockwise which turns a M6 right-hand nut clockwise causing a guide upper cap assembly to move up synchronously with moving quadrants.

20. The method for adjusting the size of the mannequin head of claim 19, wherein turning said driver lower gear assembly counterclockwise causing the connecting spinal gear assembly to turn counterclockwise which turns said M6 right-hand nut counterclockwise causing the guide upper cap assembly to move down synchronously with moving quadrants.

* * * * *